United States Patent [19]

Sisco

[11] Patent Number: 4,724,627

[45] Date of Patent: Feb. 16, 1988

[54] SPORTS BOOT FOR SKIERS AND THE LIKE

[75] Inventor: Hugh Sisco, Incline Village, Nev.

[73] Assignee: SFF, Inc., Incline Village, Nev.

[21] Appl. No.: 937,604

[22] Filed: Dec. 3, 1986

[51] Int. Cl.[4] ..... A43B 5/04; A43B 7/14

[52] U.S. Cl. ..... 36/119; 36/93; 36/71

[58] Field of Search ..... 36/117-121, 36/93, 88, 71, 114, 44, 115

[56] References Cited

U.S. PATENT DOCUMENTS

| | | | |
|---|---|---|---|
| 2,671,277 | 3/1954 | Montgomery | 36/44 X |
| 2,884,646 | 5/1959 | Alber . | |
| 3,407,406 | 10/1968 | Werner et al. | 36/119 X |
| 3,581,412 | 6/1971 | Dalebout . | |
| 3,736,612 | 6/1973 | Check et al. . | |
| 3,744,159 | 7/1973 | Nishimura . | |
| 3,745,998 | 7/1973 | Rose . | |
| 3,758,964 | 9/1973 | Nishimura | 36/119 |
| 3,769,392 | 10/1973 | Tessaro . | |
| 3,786,580 | 1/1974 | Dalebout . | |
| 3,834,044 | 9/1974 | McAusland et al. . | |
| 3,848,287 | 11/1974 | Simonsen . | |
| 4,038,762 | 8/1977 | Swan, Jr. . | |
| 4,144,658 | 3/1979 | Swan, Jr. . | |
| 4,232,459 | 11/1980 | Vaccari | 36/71 |
| 4,654,986 | 4/1987 | George | 36/119 |
| 4,662,087 | 5/1987 | Beuch | 36/119 X |

FOREIGN PATENT DOCUMENTS

| | | | |
|---|---|---|---|
| 2144825 | 3/1973 | Fed. Rep. of Germany | 36/93 |
| 2456612 | 6/1975 | Fed. Rep. of Germany | 36/93 |
| 3404554 | 7/1984 | Fed. Rep. of Germany | 36/119 |
| WO85/03623 | 8/1985 | World Int. Prop. O. | 36/119 |

*Primary Examiner*—James Kee Chi

*Attorney, Agent, or Firm*—Kelly, Bauersfeld Lowry

[57] ABSTRACT

An improved sports boot is provided for use by snow skiers and the like, wherein the boot includes an improved boot liner interposed between a substantially rigid outer boot shell and the foot and lower leg region of a skier. The boot liner is defined by flexible sheet material extending about selected anatomical zones of the skier's foot and lower leg region to define a plurality of relatively small chambers each of relatively low vertical dimension and partially filled with a metered quantity of substantially uniform sized particulate. The boot liner further includes a plurality of small vents for restricted air passage between adjacent chambers, with one of said chambers communicating with a main air discharge tube. When the skier's foot and lower leg region are received into the boot shell and boot liner, and boot buckles or the like are closed, the particulate filled chambers are pressed against the skier's foot and lower leg region to force air to exhaust substantially from the chambers, thereby causing the individual chambers to assume a substantially rigid yet comfortable configuration in close conformance with the shape of the skier's foot and lower leg region. As a result, improved mechanical coupling is achieved with respect to the rigid boot shell, for a correspondingly improved mechanical coupling with a ski attached to the boot.

23 Claims, 10 Drawing Figures

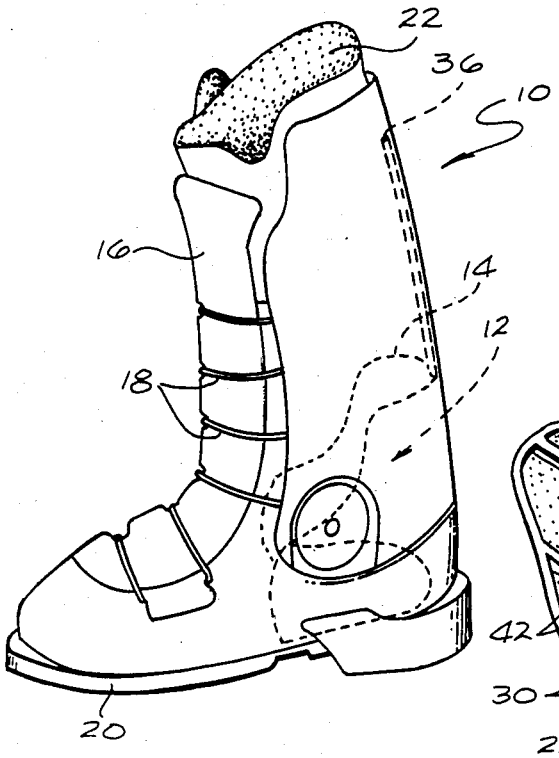
FIG. 1
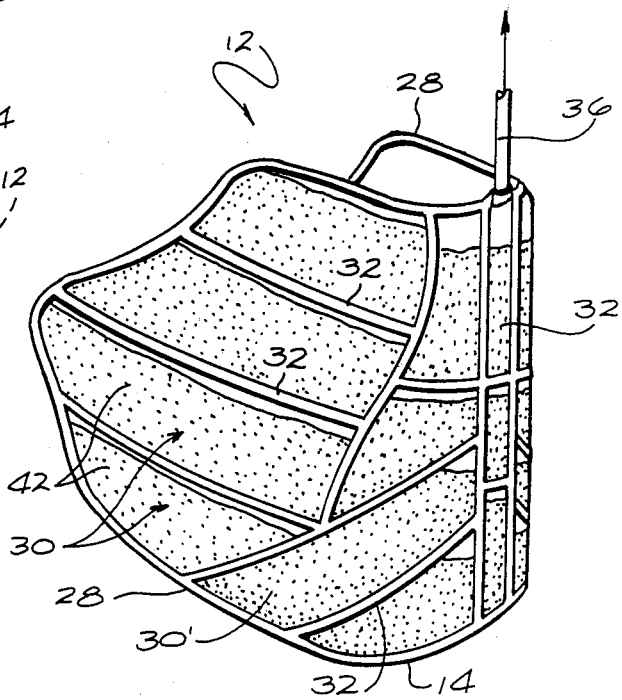
FIG. 2
FIG. 3
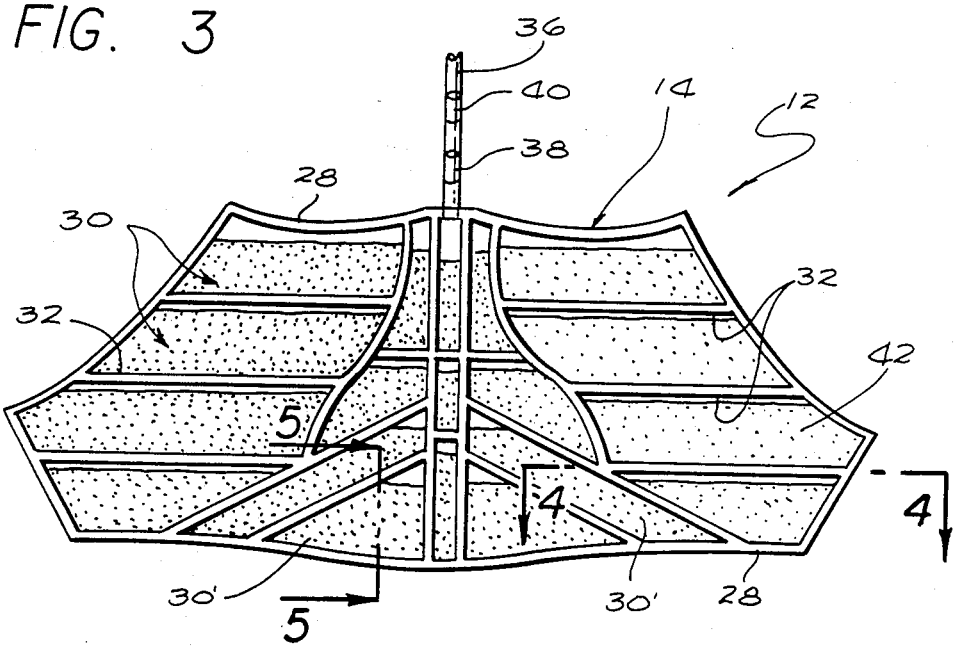

FIG. 4
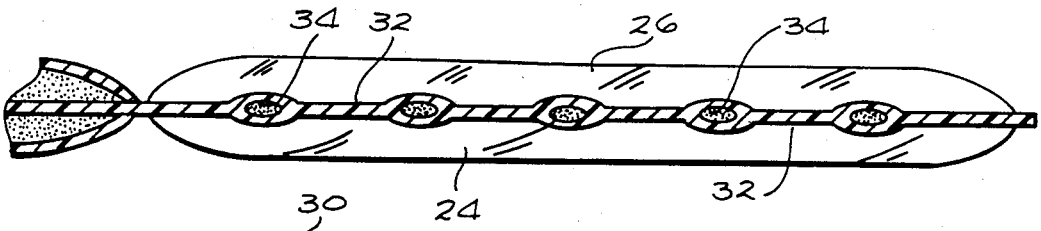
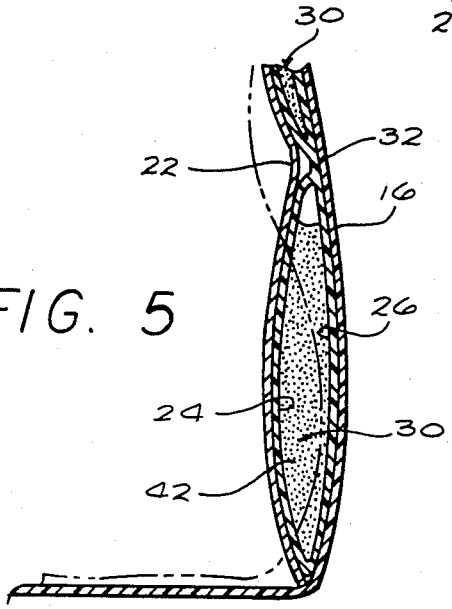
FIG. 5
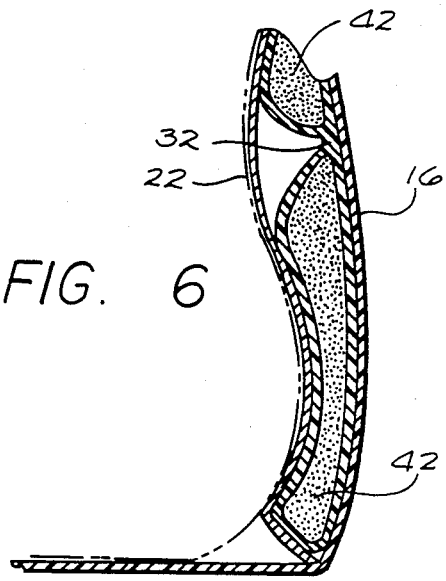
FIG. 6
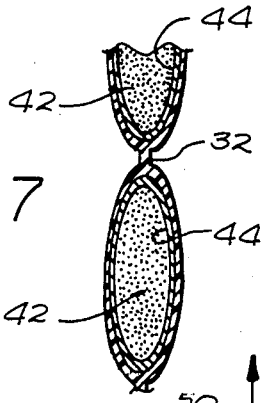
FIG. 7
FIG. 8
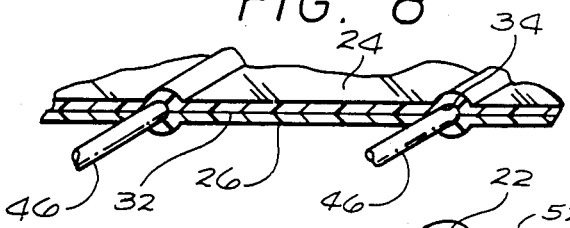
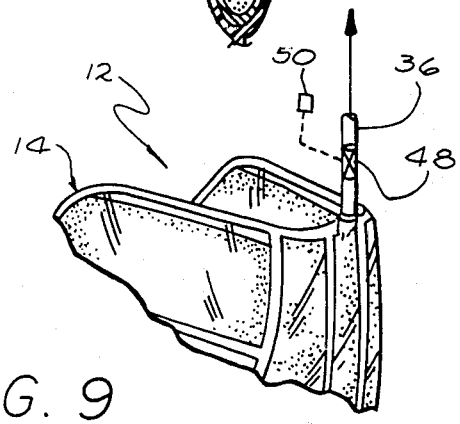
FIG. 9
FIG. 10
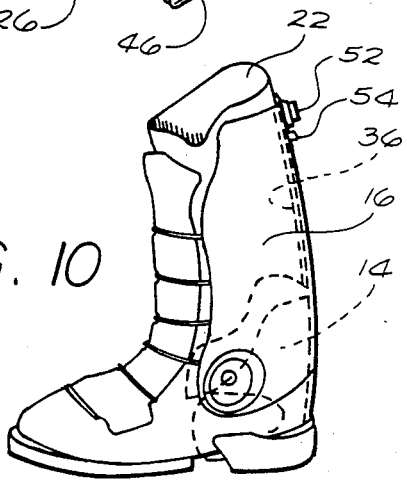

SPORTS BOOT FOR SKIERS AND THE LIKE

BACKGROUND OF THE INVENTION

This invention relates generally to an improved sports boot of the type adapted for use by snow skiers, ice skaters, and the like. More particularly, this invention relates to an improved sports boot of the type requiring close mechanical coupling of a person's foot and lower leg region with an outer boot shell.

In the sport of snow skiing, it is well known to provide a ski boot adapted for releasable yet substantially rigid mechanical attachment to a snow ski. Such rigid ski boots typically include a relatively tall outer boot shell of substantially rigid construction designed to extend upwardly about the skier's foot and ankle and further about a region of the skier's lower leg. Such ski boots are conventionally designed to fit the skier's foot in a relatively tight manner to obtain an optimum mechanical coupling between a snow ski and the person's foot. This close mechanical coupling is required to insure accurate and stable ski movements in response to foot and leg movements for enhanced ski performance. Similar mechanical considerations are also encountered in other types of sports footwear, for example, in ice skates and the like requiring close mechanical coupling between the foot and a mechanical implement, e.g. the skate blade.

In the past, ski boots and other similar types of athletic footwear have been designed with a high degree of mechanical stiffness in an effort to optimize mechanical coupling between the foot and the snow ski or other implement. However, such rigid boots inherently tend to be significantly uncomfortable whereby substantial cloth and/or foam padding are normally provided between the skier's foot and the rigid outer boot shell in an effort to provide some degree of user comfort. This cloth and/or other padding material unfortunately accommodates relative foot motion with respect to the outer boot shell and thereby at least partially defeats the desired close mechanical coupling. Moreover, the addition of cloth and/or other padding material does not by itself accommodate foot size changes which can occur during the course of a day, for example, due to temperature induced swelling or contraction of the foot, whereby the boot can still become uncomfortably tight or undesirably loose unless periodic boot size adjustments are made.

A wide variety of ski boot designs have been proposed over the years for achieving improved mechanical coupling between the skier's foot and a substantially rigid outer boot shell. Such designs include, by way of example, inflatable boot liners adapted to receive and contain a supply of air under pressure and/or to receive a curable foam elastomer substance, wherein the bladders are designed to conform with the specific shape of a person's foot when the boot is closed and tightened over the foot. However, while these approaches offer some improvements in mechanical coupling with the outer boot shell, they also tend to apply positive forces to the person's foot and are thus relatively uncomfortable over any significant period of time. Moreover, the use of injectable and/or curable foam elastomers provides limited mechanical coupling capability due to gradual inelastic deformation of the foam substance.

In one other proposed boot arrangement, a flexible chamber-forming member has been proposed at each side of the skier's foot wherein the chamber-forming member is partially filled with particulate such as plastic or glass beads. The chamber-forming member is then evacuated prior to use of the boot with the intent of rigidizing the particulate material in a shape generally conforming with the person's foot and thus provide an improved mechanical coupling with a rigid outer boot shell. See, for example, German Pat. No. 3,404,554. This arrangement, however, is impractical and essentially nonfunctional in use since the particulate material will tend to fall to the bottom of the chamber-forming member each time the boot is taken off the foot. When the skier subsequently reinserts his foot into the boot, the skier's foot will push the particulate material toward the bottom of the boot where it cannot engage or conform with upper zonal regions of the foot, ankle, and lower leg region.

The present invention overcomes the problems and disadvantages of the prior art by providing a further improved ski boot of the like having a specific arrangement of multiple flexible chambers filled partially with particulate material, wherein the chamber array is adapted to support and maintain the particulate material over the requisite anatomical zones of a skier's foot and lower leg region.

SUMMARY OF THE INVENTION

In accordance with the invention, an improved sports boot is provided for use by skiers and the like, wherein the boot is designed for improved close mechanical coupling of the skier's foot and lower leg region with a substantially rigid outer boot shell. This improved mechanical coupling is achieved by interposing an improved boot liner defining an array of relatively small chambers distributed over selected anatomical zones of the foot with each chamber partially filled with a metered quantity of particulate material designed to conform with the shape of the foot and to assume a substantially rigid configuration upon expulsion of air from the chambers.

In one preferred form of the invention, the boot liner comprises flexible sheet material formed in two layers with a substantially sealed periphery and configured to fold about the rear and adjacent rear sides of a person's foot, and further to extend upwardly at least a short distance above the person's ankle region. The dual layers of sheet material are further interconnected within the bounds of the sealed periphery along a plurality of contact lines to define a plurality of relatively small individual chambers, each of relatively low vertical height. These chambers are individually filled partially with a selected, metered quantity of particulate material, with lightweight hollow ceramic spheres or beads being preferred and having a substantially uniform size within the range of about to 40 to 120 mesh. These contact lines separating the individual chambers are formed to include relatively small air vents for permitting restricted passage of air between the various chambers, with at least one of the chambers located preferably at the upper rear of the liner being communicated to atmosphere via a main discharge tube.

In use, when the boot liner is interposed between a person's foot and a substantially rigid outer shell of a ski boot or the like, and the boot is closed about the foot in a normal manner, the person's foot and lower leg region apply pressure to each of the plurality of chambers thereby causing most or all of the air to be expelled from the chambers through the air vents and eventually through the main discharge tube. Such explusion of air is accompanied by shape conformance of the individual chambers to closely match the anatomical contours of the person's foot and lower leg region. When the substantial portion of the air is expelled from the chambers, the particulate within these chambers exhibits a substantially rigid geometry for optimum mechanical coupling of the foot and lower leg region with the rigid outer boot shell. In this regard, some of all of the particulate-filled chambers can be anatomically positioned for enhanced interlock with the foot, for example, by including chambers extending over and in front on the heel bone of the skier's foot to lock the heel bone in place relative to the boot.

Other forms of the invention may incorporate means for preventing particulate migration from chamber to chamber through the narrow air vents. Such particulate restraining means may include particulate filters such as flexible filter bags encasing the particulate within each chamber, or filter elements protruding through each vent. Still further, the main discharge tube may include a particulate-blocking filter. The discharge tube may also, if desired, include a moisture absorbing desiccant, and/or a one-way check valve to prevent air ingress into the chambers during boot use. A vacuum pump may also be associated with the main discharge tube for permitting a vacuum to be drawn within the chambers.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view illustrating a ski boot including an improved boot liner embodying the novel features of the invention:

FIG. 2 is an enlarged perspective view illustrating a portion of the a preferred boot liner for use in the ski boot of FIG. 1;

FIG. 3 is a developed plan view of the boot liner shown in FIG. 2;

FIG. 4 is an enlarged fragmented sectional view taken generally on the line 4—4 of FIG. 3;

FIG. 5 is an enlarged fragmented sectional view taken generally on the line 5—5 of FIG. 3;

FIG. 6 is an enlarged fragmented sectional view similar to FIG. 5 but illustrating shape adaptation of a portion of the improved boot liner to accommodate the anatomical contours of a person's foot;

FIG. 7 is an enlarged fragmented sectional view through a portion of a ski boot liner embodying one alternative form of the invention;

FIG. 8 is a fragmented perspective view illustrating another alternative form of the invention;

FIG. 9 is a fragmented perspective view illustrating still another alternative form of the invention; and FIG. 10 is a perspective view of an alternative ski boot similar to FIG. 1 but depicting still another alternative form of the invention.

DETAILED DESCRIPTION OF THE PREFERRED EMBODIMENTS

As shown in the exemplary drawings, an improved ski boot is referred to generally by the reference numeral 10 in FIG. 1. The ski boot 10 includes an improved boot liner 12 having a particle containing flexible bladder 14 adapted for enhanced close mechanical coupling of a skier's foot and lower leg region (not shown in FIG. 1) with a substantially rigid or hard outer boot shell 16. As a result, movements of the skier's foot and lower leg region are accurately and substantially instantaneously transmitted to the boot shell 16 for corresponding transfer to a snow ski (not shown) to achieve enhanced ski stability, control and performance. Alternately, the improved liner 12 may be incorporated into other types of athletic footwear and the like, such as ice skates, wherein close mechanical coupling of a person's foot and lower leg region are desired relative to a boot mounted implement such as a snow ski, ice skate blade, etc.

The improved ski boot 10 of the present invention advantageously provides substantially optimum mechanical coupling of the person's foot and lower leg region with the rigid outer boot shell 16 each time the person's foot is placed into the boot and the boot is closed by means of the illustrative buckles 18 or other suitable closure members. The inner liner 12 substantially conforms anatomically with the configuration of the person's heel, rear foot region, and upper ankle region each time the boot is worn, and in a manner accommodating foot shape changes or wearing of the boot by different persons. Importantly, however, the boot liner conforms with the shape of the person's foot and lower leg region in a manner which is comfortable over a prolonged period of time, and which will accommodate minor changes in foot size or shape through the course of use while continuing to provide firm, substantially unyielding mechanical coupling with the outer boot shell 16.

As shown generally in FIG. 1, the exemplary ski boot 10 conventionally includes the substantially rigid outer boot shell 16 of molded plastic or the like with an upwardly open boot geometry to enclose a person's foot and ankle and a portion of the lower leg region extending above the ankle region. The boot shell 16 includes a lower sole 20 having an appropriate size and shape for mechanical attachment by appropriate binding means to a snow ski (not shown). The improved liner 12 comprises a normally flexible inner boot received within the outer shell 16 and including a flexible fabric or thin foam sock component 22 for lining the person's foot and lower leg region. The liner 12 further includes the flexible bladder 14 interposed between the sock component 22 and the outer shell 16 at the heel and ankle region of the boot, as shown in dotted lines in FIG. 1.

The flexible bladder 14 of the inner boot liner 12 is shown in more detail in one preferred form in FIGS. 2–6. More particularly, this bladder 14 is defined by overlying inboard and outboard layers 24 and 26 of flexible plastic sheet material, such as a durable polyurethane sheet material or the like having a size and shape for relatively smooth contoured folding about the rear sides, heel and upper ankle regions of a person's foot. These layers 24 and 26 are arranged with a generally common perimeter sealed together by a by a heat seam 28 or the like to prevent perimetral escape of air from between the two sheet layers. This bladder 14 is preferably secured within the boot shell 16 by direct affixation with glue or the like to the exterior of the sock component 22 (FIGS. 5 and 6), although the bladder may be secured directly to the inboard side of the outer shell 16, if desired.

In accordance with a primary feature of the invention, the internal volume of the bladder 14, defined by the space between the two sheet material layers 24 and 26, is subdivided into a plurality of relatively small individual chambers 30 distributed over the areas of the sheet layers. More particularly, as shown best in FIGS. 2–4, these individual chambers 30 are defined cooperatively by the outer perimeter seam 28 and/or by an array of inner seams 32 formed by heat sealing or the like to interconnect the overlying layers 24 and 26 to each other. Each of these chambers 30 is relatively small in size and has a relatively low vertical profile within the range of about 0.75 inch to 2.0 inches, and most preferably about 1.0 inch, thereby providing a vertically stacked plurality of chambers on each side and behind the skier's foot within the boot. In a typical ski boot, therefore, there will be at least two and typically four or five vertically stacked chambers 30 on each side of the skier's foot to provide sufficient bladder height extending from the heel upwardly to a point above the skier's ankle bone, with four such stacked bladder chambers being depicted in the illustrative drawings.

In addition, as shown best in FIGS. 2 and 3, each side of the bladder 14 includes at least one anatomically located chambers 30' for locking engagement with the skier's heel bone, as will be further described herein. Such chambers 30' are depicted in FIGS. 2 and 3 as angled chambers extending from the rear of the bladder in a downward and forward direction to a lower bladder margin, thereby extending above the inboard and outboard sides of the heel bone to a forwardmost position in front of the heel bone. Similar anatomical chamber positioning may be performed relative to the skier's ankle bone, for example, by locating inner seams 32 in vertical alignment with the ankle bone.

In accordance with one aspect of the invention, the inner seams 32 are interrupted at spaced intervals, as viewed in FIG. 4, to define relatively small air vents 34 permitting restricted or limited air passage between adjoining chambers 30. In the preferred form, a plurality of such vents each having a diametric size of about 0.030 to 0.040 inch are provided to interconnect each adjoining pair of chambers. One of the chambers 30, preferably at the upper rear of the bladder 14, is communicated to atmosphere via a main air discharge tube 36 which may extend upwardly within the rear of the outer boot shell 16 terminating a short distance below the upper margin of the shell 16, as viewed in FIG. 1. A filter element 38 may be included within the discharge tube 36 to prevent loss of particulate from the chamber 30, as will be described in more detail. A desiccant 40 may also be provided, if desired, to prevent moisture ingress into the chambers.

Each of the relatively small chambers 30 is substantially although not entirely filled with a metered quantity of a selected particulate material 42, such as small ceramic or glass beads having a substantially uniform size within the range of from about 40 to about 120 mesh. For optimum lightweight characteristics, hollow ceramic microspheres of the type available from Fillite Company, Huntington, Virginia, are preferred, with such microspheres having diametric sizes within the range of about 50 to about 70 mesh.

When a skier places his foot into the boot 10 and closes the boot by means of the buckles or the like, the skier's foot is placed against the inboard bladders layer 24 in pressing relation with the array of chambers 30. This pressing of the foot against the bladder 14 causes the various chamber to deform individually from a relaxed state as depicted generally in FIG. 5 to a deformed state conforming generally with the anatomical contour of the skier's foot and lower leg region, as viewed in FIG. 6. Such pressure-induced deformation of the various chambers is accompanied by a reduction in overall chamber volume as air within the chambers is expelled through the air vents 34 from one chamber to another and ultimately from the bladder through the main discharge tube 36. As most or all of the air is expelled from the liner, the particulate material 42 within each chamber 30 is displaced into a substantially rigid interlocking geometry to define a substantially rigid component mechanically coupled between the skier's foot and lower leg region and the rigid outer boot shell 16. As a result, skier foot and leg movements are transmitted accurately and efficiently to the outer boot shell 16 for corresponding transfer to a ski attached to the boot. Importantly, while the air vents permit pressure-induced air expulsion from the chambers 30, external ambient pressure thereafter acts upon the bladder to partially close down the air vents to an effective smaller passage size. Accordingly, once the air is expelled from the chambers, subsequent reentry of air into the chambers is necessarily slower in time due to the partially closed nature of the vents.

In use, rapid foot and leg movements within the boot 10, and within the bladder 14, are transmitted to the outer boot shell 16 for substantially optimum skiing performance. The air vents 34 interconnecting the various chambers 30 restrict air ingress and egress relative to the bladder chambers sufficiently to prevent rapid change in bladder shape during such rapid foot movements. However, relatively slow foot movements such as foot size changes as may occur due to temperature-induced swelling or contraction during a skiing day, are accompanied by relatively slow ingress or egress of air from the bladder chambers to accommodate such size changes without requiring boot buckle adjustments.

The stiffness of the boot during use in skiing or the like can be selected according to the preferences of the individual user. For example, within the preferred range of particulate size of 50 to 70 mesh, smaller size particulate has been found to increase the bladder stiffness or resistance to rapid shape changes in response to rapid foot movements. Conversely, larger size particulate will produce bladder dynamics of somewhat reduced stiffness, for example, as may be desired for recreational as opposed to competitive skiing. In any case, however, it has been found that the particulate used must be of substantially uniform size for achieving the desired interlocking stiff particulate array when air is expelled from the various chambers.

In accordance with further aspects of the invention, filter means may be provided for preventing particulate material migration from one chamber to another during use of the boot. More particularly, filter bags 44 (FIG. 7) of flexible air-permeable cloth or the like may be provided within each chamber 30 to encase the particulate material 42 therein, thereby preventing undesired particulate migration between chambers through the air vents 34. Alternately, as viewed in FIG. 8, filter elements 46 may be placed directly within the air vents 34 to prevent interchamber particulate material migration.

In accordance with further alternative forms of the invention, the main discharge tube 36 may be equipped with a discharge check valve 48 (FIG. 9) designed to permit air egress without return ingress into the chambers, thereby maintaining a substantial vacuum within the various chambers during boot use. A valve operator 50 of any suitable design may be included for opening the check valve 48 to release the vacuum within the chambers when it is desired to remove the boot, for example, at the end of a skiing session. Still further, as viewed in FIG. 10, a vacuum pump 52 may be provided for use in manually pumping air from the chambers 30 prior to boot use, with an appropriate release button 54 being provided to release the vacuum prior to boot removal. Such vacuum pump 52 and release button 54 would be similar in form to positive pressure pumps of the type used in the prior art for pressurizing a ski boot bladder as shown, for example, in U.S. Pat. No. 4,232,459.

The improved ski boot 10 of the present invention, including the improved boot liner 12, thus provides a relatively simple yet highly effective apparatus for comfortably conforming to the size and shape of a skier's foot while providing close mechanical coupling with a rigid outer boot shell 16. The improved liner responds dynamically to rapid foot and leg positional changes to transmit accurate mechanical forces to the rigid outer boot shell for subsequent transmission to a ski or the like. However, relatively slow changes in foot size and shape, for example, as may occur over several hours during the course of a skiing session, are accommodated by slow liner change in size and shape, thereby enhancing comfortable wearing of the boot.

Other modifications and improvements to the invention described herein will be apparent to those skilled in the art. Accordingly, no limitations on the invention are intended by way of the description herein, except as set forth in the appended claims.

What is claimed is:

1. A sports boot for skiers and the like for receiving a person's foot, said boot comprising, in combination:

a substantially rigid outer boot shell for receiving a person's foot; and a boot liner receivable within said shell, said liner including a flexible bladder having a size and shape to fit within said shell in a position folded generally about the rear and rear sides of the person's foot received within said shell, and further to extend upwardly at least a short distance above the ankle region of the person's foot;

said bladder being subdivided into a plurality of individual vented chambers each of relatively low vertical dimension and including a plurality of said chambers in vertically stacked relation on opposite sides of the person's foot;

each of said chambers being at least partially filled with a particulate material of substantially uniform particle size and further including means permitting expulsion of a substantial portion of the air from said chambers when the person's foot is received into said boot shell so that said particulate material within each of said chambers assumes a substantially rigid configuration in general conformance with the adjacent anatomical shape of the person's foot for improved mechanical force coupling between the person's foot and said boot shell.

2. The sports boot of claim 1 wherein said sports boot comprises a snow ski boot, said boot further including means for releasable connection to a snow ski.

3. The sports boot of claim 1 wherein said bladder is formed from a pair of flexible overlying layers of air impermeable sheet material with a substantially sealed peripheral seam to prevent escape of air from between said layers, and further including a plurality of inner seams interconnecting said layers to define said plurality of chambers, each of said inner seams including vent means for permitting migration of air between adjacent ones of said chambers, and a main air discharge tube in communication with one of said chambers to permit ingress and egress of air from between said bladder layers.

4. The sports boot of claim 3 further including filter means within said main air discharge tube to prevent escape of particulate material from between said bladder layers.

5. The sports boot of claim 3 further including filter means for preventing migration of said particulate material from one of said chambers to another.

6. The sports boot of claim 3 further including desiccant means for preventing ingress of moisture into said chambers.

7. The sports boot of claim 3 further including a one-way check valve along said main air discharge tube for releasably preventing ingress of air into said chambers.

8. The sports boot of claim 3 further including vacuum pump means for manually drawing air from said chambers and for releasably maintaining a vacuum within said chambers.

9. The sports boot of claim 1 wherein said plurality of chambers on each side of the person's foot includes at least one chamber extending from the rear of said shell over the top of the person's heel bone and then extending downwardly in front of the person's heel bone to a lower margin of the bladder to lock the heel bone in place during boot use.

10. The sports boot of claim 3 wherein said vent means comprises a plurality of small openings along said inner seam between each of said chambers, said small openings having a diametric size of from about 0.030 to about 0.040 inch.

11. The sports boot of claim 1 wherein each of said chambers has a relatively low vertical dimension on the order of about 0.75 inch to about 2.0 inch.

12. The sports boot of claim 11 wherein each of said chambers has a relatively low vertical dimension on the order of about 1.0 inch.

13. The sports boot of claim 1 wherein said particulate material has a substantially uniform size selected from within the range of about 40 to about 120 mesh.

14. The sports boot of claim 13 wherein said particulate material has a size selected from within the range of about 50 to about 70 mesh.

15. The sports boot of claim 13 wherein said particulate material comprises hollow microspheres of a ceramic-based material.

16. The sports boot of claim 1 wherein said liner further includes a sock component for reception into said boot shell, said sock component having said bladder secured thereto.

17. A sports boot for skiers and the like for receiving a person's foot, said boot comprising, in combination:

a substantially rigid outer boot shell for receiving a person's foot; and a boot liner receivable within said shell, said liner including a flexible bladder having a size and shape to fit within said shell in a position folded generally about the rear and rear sides of the person's foot received within said shell, and further to extend upwardly at least a short distance above the ankle region of the person's foot;

said bladder being formed from a pair of overlying layers of air impermeable sheet material and including a peripheral seam joining said layers together to prevent escape of air from between said layers, and further including a plurality of inner seams interconnecting said layers together to subdivide said bladder into a plurality of relatively small chambers of relatively low vertical dimension, each of said inner seams having relatively small vent openings formed therein to permit migration of air from one chamber to another, at least one of said chambers being communicated to atmosphere, said bladder including a plurality of said chambers in vertically stacked relation on opposite sides of the person's foot;

each of said chambers being at least partially filled with a particulate material of substantially uniform particle size, said vent openings permitting explusion of a substantial portion of the air from said chambers when the person's foot is received into said boot shell so that said particulate material within each of said chambers assumes a substantially rigid configuration in general conformance with the adjacent anatomical shape of the person's foot for improved mechanical force coupling between the person's foot and said boot shell.

18. The sports boot of claim 17 further including a main air discharge tube for communicating said at least one of said chambers to atmosphere.

19. A sports boot for skiers and the like for receiving a person's foot, said boot comprising, in combination:

a substantially rigid outer boot shell for receiving a person's foot; and a boot liner receiveable within said shell, said liner including a flexible bladder having a size and shape to fit within said shell in a position folded generally about the rear and rear sides of the person's foot received within said shell, and further to extend upwardly at least a short distance above the ankle region of the person's foot;

said bladder being formed from a pair of overlying layers of air impermeable sheet material and including a peripheral seam joining said layers together to prevent escape of air from between said layers, and further including a plurality of inner seams interconnecting said layers together to subdivide said bladder into a plurality of relatively small chambers of relatively low vertical dimension, each of said inner seams having relatively small vent openings formed therein to permit migration of air from one chamber to another, at least one of said chambers being communicated to atmosphere, said bladder including a plurality of said chambers in vertically stacked relation on opposite sides of the person's foot;

each of said chambers being at least partially filled with a particulate material of substantially uniform particle size within the range of from about 50 to about 70 mesh, said vent openings permitting explusion of a substantial portion of the air from said chambers when the person's foot is received into said boot shell so that said particulate material within each of said chambers assumes a substantially rigid configuration in general conformance with the adjacent anatomical shape of the person's foot for improved mechanical force coupling between the person's foot and said boot shell.

20. The sports boot of claim 19 further including filter means for preventing migration of said particulate material from one chamber to another.

21. A support device for receiving and supporting an anatomical joint of a person, such as for receiving and supporting the ankle region or the like of a person's foot, said support device comprising, in combination:

a substantially rigid outer shell having a size and shape for mounting about the anatomical joint; and a liner receivable within said shell, said liner including a flexible bladder having a size and shape to fit within said shell in a position folded generally about the anatomical joint received within said shell;

said bladder being subdivided into a plurality of individual vented chambers each of relatively low vertical extension and including a plurality of said chambers in vertically stacked relation on at least opposite ides of the anatomical joint;

each of said chambers being at least partially filled with a particulate material of substantially uniform particle size and further including means permitting expulsion of a substantial portion of the air from said chambers when the anatomical joint is received into said shell so that said particulate material within each of said chambers assumes a substantially rigid configuration in general conformance with the adjacent anatomical shape of the joint for improved mechanical force coupling between the joint and said shell.

22. A sports shoe for receiving a persons's foot, said shoe comprising, in combination:

an outer shoe member for receiving a person's foot;

a liner receivable within said shoe member, said liner including a flexible bladder having a size and shape to fit within said shoe member in a position folded generally about the rear and rear sides of the person's foot received within said shoe member, and further to extend upwardly at least a short distance above the ankle region of the person's foot;

said bladder being subdivided into a plurality of individual vented chambers each of relatively low vertical dimension and including a plurality of said chambers in vertically stacked relation on opposite sides of the person's foot;

each of said chambers being at least partially filled with a particulate material of substantially uniform particle size and further including means permitting expulsion of a substantial portion of the air from said chambers when the person's foot is received into said shoe member so that said particulate material within each of said chambers assumes a substantially rigid configuration in general conformance with the adjacent anatomical shape of the person's foot for improved mechanical force coupling between the person's foot and said shoe member.

23. The sports shoe of claim 22 wherein said particulate material has a substantially uniform size selected from within the range of about 40 to about 120 mesh.

* * * * *